US005673950A

United States Patent [19]

Takimoto

[11] Patent Number: 5,673,950

[45] Date of Patent: Oct. 7, 1997

[54] LOCKING DEVICE FOR FASTENING A WING ELEMENT

[75] Inventor: Kazuhide Takimoto, Tokyo, Japan

[73] Assignee: Takigen Manufacturing Co., Ltd., Tokyo, Japan

[21] Appl. No.: 644,601

[22] Filed: Mar. 18, 1996

[30] Foreign Application Priority Data

Jul. 31, 1995 [JP] Japan ..... 7-214025

[51] Int. Cl.[6] ..... E05C 3/06

[52] U.S. Cl. ..... 292/197; 292/229; 292/210

[58] Field of Search ..... 292/197, 202, 292/210, 224, 132, 83, 229, 257

[56] References Cited

U.S. PATENT DOCUMENTS

| | | | |
|---|---|---|---|
| 4,325,239 | 4/1982 | Larson | 292/202 X |
| 4,586,736 | 5/1986 | Dougherty | 292/202 |
| 4,679,835 | 7/1987 | Weinerman et al. | 292/197 |
| 4,932,694 | 6/1990 | Cater, Sr. | 292/210 |
| 4,995,652 | 2/1991 | Mugnolo et al. | 292/202 |
| 5,234,236 | 8/1993 | Gromotka | 292/197 X |
| 5,409,272 | 4/1995 | Mccormack | 292/229 X |
| 5,488,808 | 2/1996 | Cahill et al. | 292/257 X |
| 5,551,188 | 9/1996 | Daviantes | 292/132 X |
| 5,551,793 | 9/1996 | Lewis | 292/197 X |

*Primary Examiner*—Rodney M. Lindsey
*Assistant Examiner*—Monica E. Millner
*Attorney, Agent, or Firm*—Martin Smolowitz

[57] ABSTRACT

There is provided a locking device for fastening a wing element where rotation of a rotor (13) effects smooth locking and unlocking of a wing element and also enables it to smoothly open and close free from interfering with a rocking arm (24); in operation rotation of the rotor (13) causes a slide cam (6) to move linearly rearward so that body (3) is rotated through a pivot (17) into an upright position, and a front-end pushing portion (18) of the arm (24) abuts on a support portion (20) of a stationary frame (19); rotor (13) is prevented from dropping out of the body (3) by ball bearings (15) rotatably mounted between annular grooves (14,9) of the body (3) and of the rotor (13); and a spring (25) rotatably biases the arm (24) to cause a base-end follower portion (23) of the arm (24) to abut on a rear-end surface of the slide cam (6).

3 Claims, 4 Drawing Sheets

LOCKING DEVICE FOR FASTENING A WING ELEMENT

BACKGROUND OF THE INVENTION

1. Field of the Invention

The present invention relates to a locking device for fastening a wing element such as ship's hatch covers and the like, to a ship's stationary frame and the like, when such wing element is in its closed position.

2. Description of the Prior Art

Many types of locking devices for fastening such wing elements have been previously proposed in construction, and in any of which, a rotor inserted into a stationary body of the device is rotated to bring a front-end pushing portion of a rocking arm into press-contact with a corresponding support portion of the stationary frame.

However, in any of the conventional locking devices, due to its construction it is laborsome for a user to rotate the rotor relative to the stationary body. Furthermore, in some of the conventional locking devices, the stationary frame often interferes with the locking arm when the wing element is opened and closed.

SUMMARY OF THE INVENTION

Consequently, it is an object of the present invention to provide a locking device for fastening a win element, which enables the user to easily rotate a rotor during the locking and unlocking operations of the device and also permits the wing element to be smoothly opened and closed without any interference with a locking arm of the device.

The above object of the present invention is accomplished by providing:

A locking device for fastening a wing element, comprising:

a stationary body fixedly mounted on the wing element, being provided with a female screw portion in an inner peripheral surface of a rear half part of its hollow portion, the female screw portion extending in a longitudinal direction of the stationary body, the hollow portion being provided with a first annular groove in an inner peripheral surface of its front half part;

a slide cam provided with a male screw portion in an outer peripheral surface of its base-end portion, the male screw portion extending in a longitudinal direction of the slide cam, the slide cam being further provided with an axially-extending non-circular cross-sectional hollow portion in its central portion, the male screw portion being threadably engaged with the female screw portion so that the slide cam is mounted in the hollow portion of the stationary body in an insertion manner;

a rotor rotatably inserted in the hollow portion of the stationary body and provided with a non-circular cross-sectional guide shaft portion in its rear half part, the guide shaft portion being non-rotatably mounted in the hollow portion of the slide cam, the rotor being further provided with an second annular groove in an outer peripheral surface of its intermediate portion, the rotor having its front disk portion connected with an operating handle through a first pivot which extends in parallel with a front surface of the wing element;

a plurality of ball bearings rotatably mounted between the first annular groove of the stationary body and the second annular groove of the rotor to prevent the rotor from slipping out of the stationary body;

a rocking arm mounted in a cut-away radial slot portion of a rear-end portion of the stationary body in an insertion manner, the rocking arm having its base-end portion connected with the stationary body through a second pivot which extends in parallel with the front surface of the wing element, the rocking arm being provided with a follower portion in its base-end portion, the follower portion abutting against a side surface of the slide cam in a locking condition in which a pushing portion of a front-end portion of the rocking arm abuts against a support portion of a stationary frame, the follower portion further abutting against a rear-end surface of the slide cam in an unlocking condition thereof; and a spring rotatably biasing the rocking arm to have the follower portion thereof abut against the slide cam.

DESCRIPTION OF THE PREFERRED EMBODIMENTS

Figure 1:
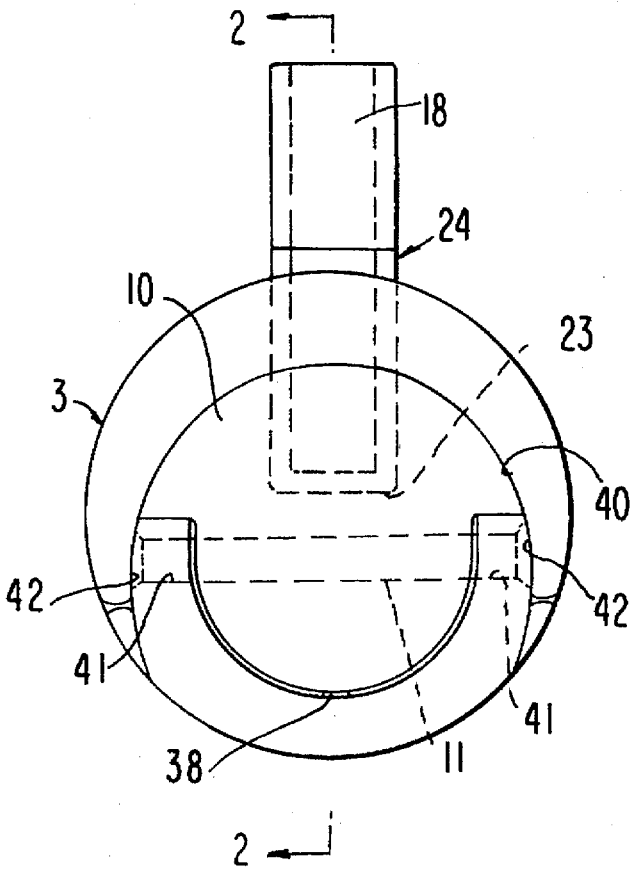
FIG. 1 is a front view of an embodiment of the locking device of the present invention for fastening a wing element, illustrating the wing element already fastened and locked.
Figure 3:
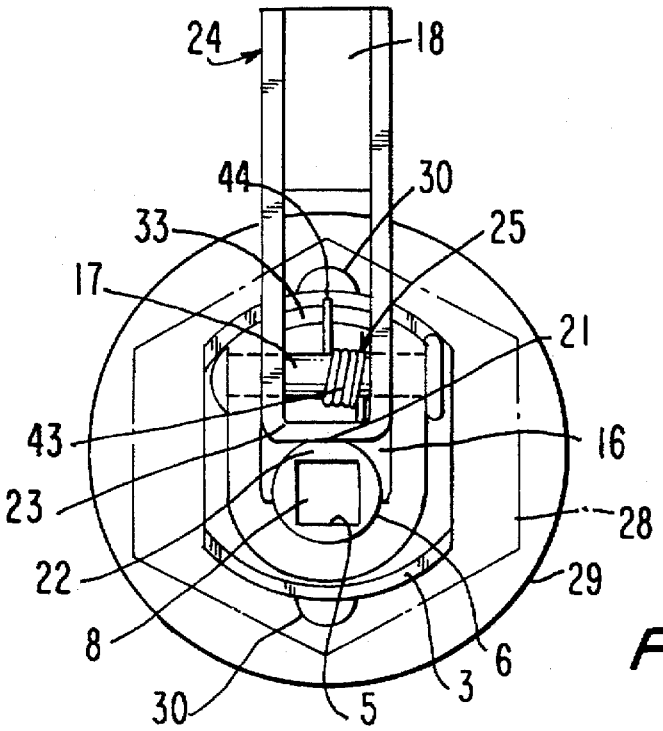
FIG. 3 is a rear view of the locking device of the present invention shown FIG. 1.

Hereinbelow, the present invention will be described in detail with reference to the accompanying drawings and the reference numerals used therein.

The locking device of the present invention for fastening a wing element 2, comprises, as its essential components: a stationary body 3; a slide cam 6; a rotor 13; a plurality of ball bearing 15; a rocking arm 24; and, a bias spring 25.

The stationary body 3 is fixedly mounted on the wing element 2, and provided with a female screw portion 1 in an inner peripheral surface of a rear half part of its hollow portion 7. The female screw portion 1 extends in a longitudinal direction of the stationary body 3. The hollow portion 7 is provided with a first annular groove 14 in an inner peripheral surface of its front half part.

A male screw portion 4 is provided on the slide cam 6 in an outer peripheral surface of its base-end portion. The male screw portion 4 extends in a longitudinal direction of the slide cam 6 which is further provided with an axially-extending non-circular cross-sectional hollow portion 5 in its central portion. The male screw portion 4 is threadably engaged with the female screw portion 1 so that the slide cam 6 is mounted in the hollow portion 7 of the stationary body 3 in an insertable manner.

The rotor 13 is rotatably inserted in the hollow portion 7 of the stationary body 3, and 15 provided with a non-circular cross-sectional guide shaft portion 8 in its rear half part. The guide shaft portion 8 is non-rotatably mounted in the hollow portion 5 of the slide cam 6. The rotor 13 is further provided with a second annular groove 9 in an outer peripheral surface of its intermediate portion, and has a front disk portion 10 connected with an operating handle 12 through a first pivot 11 which extends in parallel with a front surface of the wing element 2.

A plurality of ball bearing 15 are rotatably mounted between the first annular groove 14 of the stationary body 3 and the second annular groove 9 of the rotor 2 to prevent the rotor 2 from slipping out of the stationary body 3.

A rocking arm 24 mounted in a cut-away radial slot portion 16 of a rear-end portion of the stationary body 3 in an insertable manner, has its base-end portion connected with the stationary body 3 through a second pivot 17 which extends in parallel with the front surface of the wing element 2. The rocking arm 24 is provided with a follower portion 23 in its base-end portion. The follower portion 23 abuts against a side surface 21 of the slide cam 6 in a locking condition in which a pushing portion 18 of a front-end portion of the rocking arm 24 abuts against a support portion 20 of a stationary frame 19. The follower portion 23 further abuts against a rear-end surface 22 of the slide cam 6 in an unlocking condition thereof.

A bias spring 25 rotatably biases the rocking arm 24 causing the follower portion 23 thereof to abut against the slide cam 6.

In the assembly of an embodiment of the present invention shown in the drawings, a sleeve-like stationary body 3 is inserted into a mounting opening 26 of the wing element 2 from the front of the opening 26 then, the wing element 2 is sandwiched between: a nut 28 which is threadably engaged with a male screw portion 27 of an outer peripheral surface of the stationary body 3, and, a front disk portion 29 of the stationary body 3, so that stationary body 3 is fixedly mounted to the wing element 2. At this time, a rotation-stop projection 30 in a rear surface of the front disk portion 29 of the stationary body 3 is fitted in a peripheral notch portion 31 of the mounting opening 26 of the wing element 2. Packing 32 is mounted between the front disk portion 29 of the stationary body 3 and the wing element 2. A stopper frame portion 33 is provided in a side portion of the stationary body 3 and abuts against a side surface of the rocking arm 24 when the arm 24 rotates to reach its upright position. The above-mentioned cut-away radial slot portion 16 forms an extension of the stopper-frame portion 33.

An O-ring 34 is mounted between the front-end outer peripheral surface of the rotor 13 and the front-end inner peripheral surface of the hollow Annular packing 35 is mounted between a rear surface of the front disk portion 10 of the rotor 13 and the front disk portion 29 of the stationary body 3. Each hollow portion 5 of the slide cam 6 and the guide shaft portion 8 of the rotor 13 assumes a square shape in cross section. The hollow portion 5 opens rearward too. A click-stop member 38, inserted in a radial receiving hole 37 of the front disk portion 10 of the rotor 13, is resiliently engaged with a concave inner surface portion 39 of the operating handle 12 when the handle 12 is directed downwardly on the front disk portion 10, so that the handle 12 is held in its rest position. The front disk portion 10 of the rotor 13 is fitted in a recess portion 40 of the corresponding front disk portion 29 of the stationary body 3, so that the operating handle 12 assuming a U-shaped form has its base-end portion disposed in the recess portion 40.

The first pivot 11, which is mounted in a through-hole 41 of the base-end portion of the operating handle 12 in an insertable manner, is prevented from dropping out of the the stationary body 3 by means of inner wall surfaces 42 of the recess portion 40, so that there is no need for staking, i.e., clinching opposite ends of the pivot 11 flat with a press. The, the bias spring 25 for biasing the rocking arm 24 is constructed of a coiled torsion spring, and has its coiled portion 43 mounted on the second pivot 17 in an insertable manner, one of its linear portions 44, abuts against a side wall surface of the stopper-frame portion 33 and the other 45 abuts against an inner surface of the follower portion 23 of the rocking arm 24, the follower portion 23 assuming a plate-like form. The second pivot 17 of the rocking arm 24 is so disposed as to be closer to the stopper-frame portion 33 than the hollow portion 7, to thereby provide an escape notch portion 46 near the second pivot 17 in a base-end corner portion of the rocking arm 24. The rocking arm 24 is thus prevented from interfering with the stopper-frame portion 33 when the arm 24 is rotated into its upright position.

Figure 2:
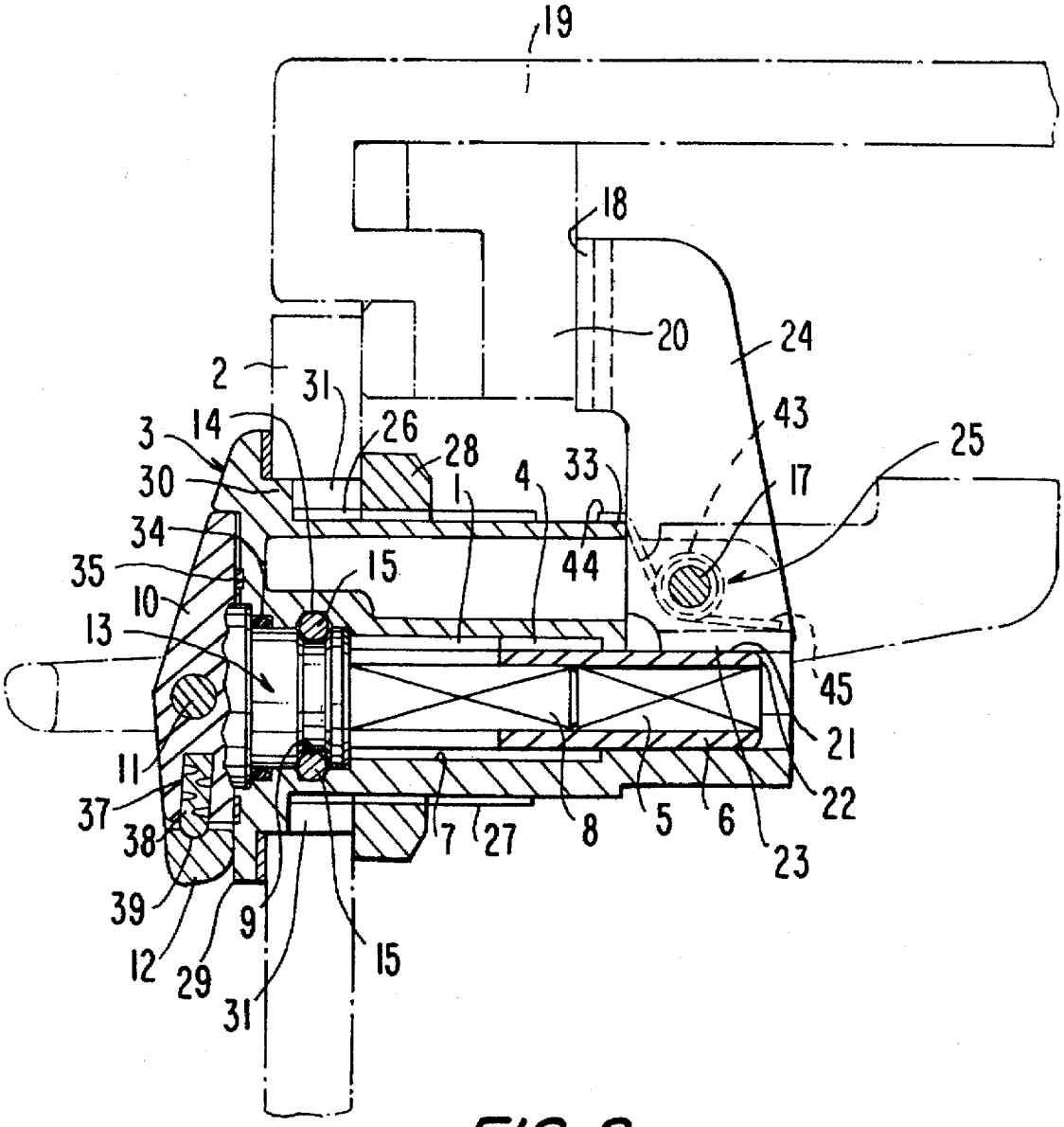
FIG. 2 is a longitudinal sectional view of the locking device of the present invention in the locking condition, taken along the line 1—1 of FIG. 1.
Figure 4:
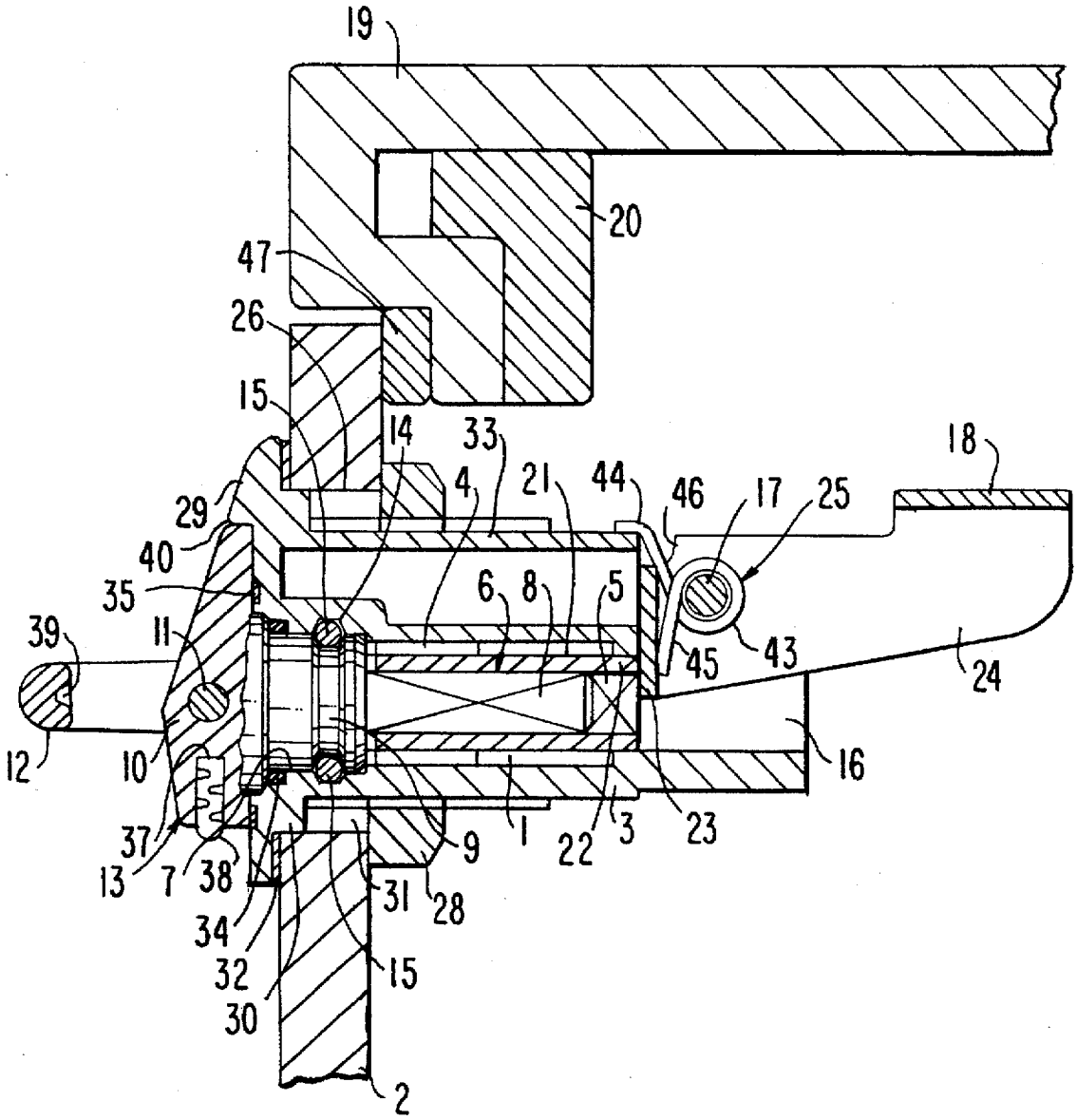
FIG. 4 is a longitudinal sectional view of the locking device of the present invention in the unlocking condition, taken along the line 1—1 of FIG. 1.
Figure 5:
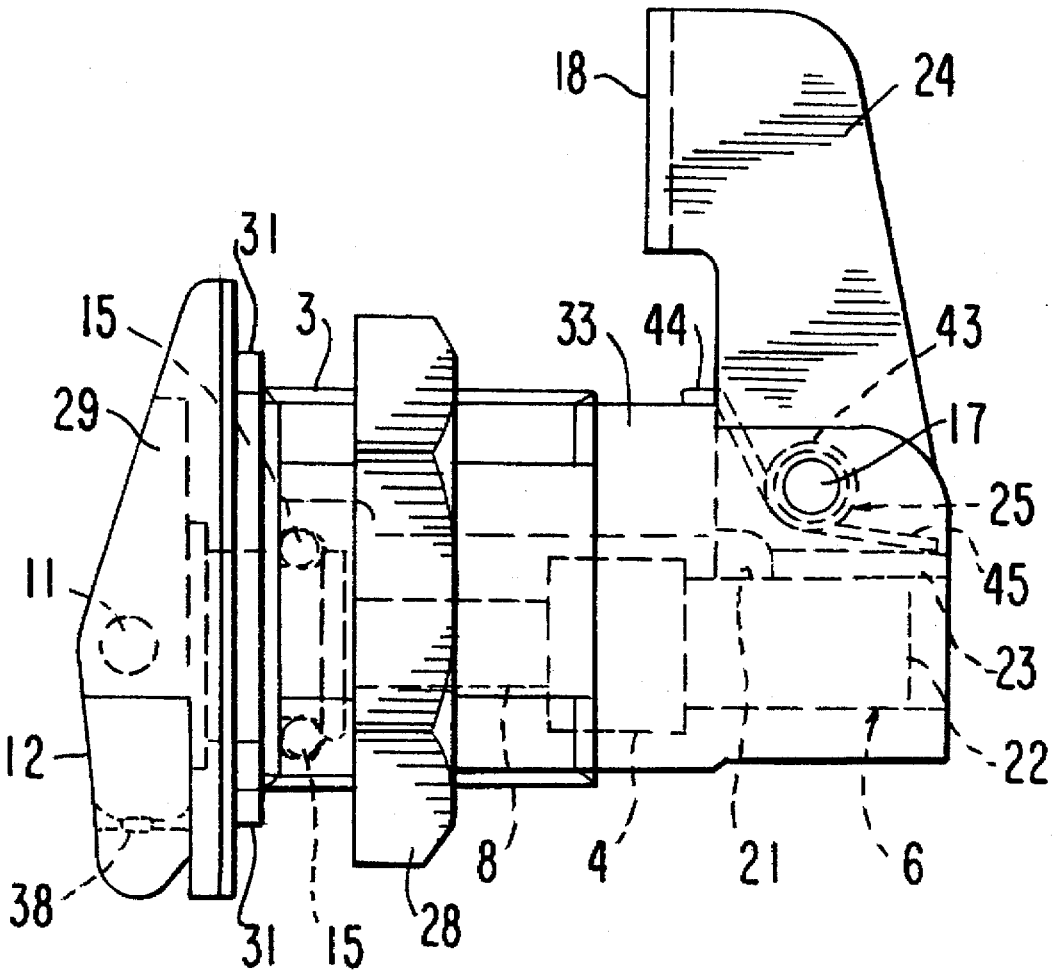
FIG. 5 is a right-side view of the locking device of the present invention shown in FIG.1.

As shown in FIG. 4, in the unlocking position of the rocking arm 24, the pushing portion 18 of the arm 24 is disengaged from the support portion 20 of the stationary frame 19 and, the follower portion 23 of the rocking arm 24 abuts against the rear-end surface 22 of the slide cam 6. The rocking arm 24 held in its rest position under the influence of a resilient force exerted by the spring 25, so that in the rest position, arm 24 extends in an axial direction of the stationary body 3. Consequently, when the wing element 2 is opened and closed, there is no fear that the rocking arm 24 interferes with an edge portion of the stationary frame 19. In FIG. 2, the operating handle 12 is held in its thrown-down position parallel to the front surface of the wing element 2.

When the operating handle 12 is pulled forward so as to rotate the handle 12 on the first pivot 11 and then the user rotates the rotor 13 in a predetermined direction, the slide cam 6 having been prevented from rotating relative to the rotor 13 linearly moves rearward due to threadable engagement between the male screw portion 4 of the slide cam 6 and the female screw portion 1 of the stationary body 3. Such linear rearward movement of the slide cam 6 causes the rear-end surface 22 of the slide cam 6 to push the follower portion 23 of the rocking arm 24, and the rocking arm 24 overcomes the resilient force of the spring 25 to rotate into its upright position. At this time, since the plurality of the ball bearings 15 rotate in the annular groove 14 of the stationary body 3 and the annular groove 9 of the rotor 13, the rotor 13 may rotate with a minimum friction loss.

The side surface of the rocking arm 24 held in its upright position perpendicular to the axial direction of the stationary body 3 abuts against the stopper-frame portion 33 of the stationary body 3, while the pushing portion 18 of the rocking arm 24 abuts against the support portion 20 of the stationary frame 19, so that the wing element 2 is locked and fastened to the stationary frame 19. At this time, the packing 47 mounted between a rear peripheral portion of the wing element 2 and a peripheral portion of the opening of the stationary frame 19 is compressed.

In the locking device of the present invention having the above construction for fastening the wing element 2, the rotor 13 may rotate relative to the stationary body 3 with a minimum friction loss due to the presence of the ball bearings 15, and the rocking arm 24 is forcibly held in its rest position under the influence of the resilient force exerted by the spring 25, which enables the wing element 2 to smoothly open and close without interfering with the rocking arm 24. Since the ball bearings 15 also serve as a means for preventing the rotor 13 from dropping out of the stationary body 3, there is no need for a separate means for such prevention, as a result there is a considerable reduction of the number of constituent elements of the locking device of the present invention.

What is claimed is:

1. A locking device in combination with a wing element (2), said device comprising:

a stationary body 3 fixedly mounted on said wing element (2), said stationary body (3) being provided with a female screw portion (1) in an inner peripheral surface of a rearward part having a hollow portion (7), said female screw portion (1) extending in a longitudinal direction of said stationary body (3); said hollow portion (7) being provided with a first annular groove (14) in an inner peripheral surface of a front part;

a slide cam 6, said slide cam (6) being provided with a male screw portion (4) in an outer peripheral surface of a base-end portion, said male screw portion (4) extending in a longitudinal direction of said slide cam 6, said slide cam (6) being further provided with an axially-extending non-circular cross-sectional hollow portion (5) in a central portion, said male screw portion (4) being threadably engaged with said female screw portion (1) so that said slide cam (6) is mounted in said hollow portion (7) of said stationary body (3) in an insertable manner;

a rotor (13) said rotor being rotatably inserted in said hollow portion (7) of said stationary body (3) having a non-circular cross-sectional guide shaft portion (8) in a rear part, said guide shaft portion (8) being non-rotatably mounted in said hollow portion (5) of said slide cam (6), said rotor (13) being further provided with a second annular groove (9) in an outer peripheral surface of an intermediate portion, and a front disk portion (10) connected with an operating handle (12) through a first pivot (11) which extends in parallel with a front surface of said wing element (2);

a plurality of ball bearings (15), being rotatably mounted between the first annular groove (14) of said stationary body (3) and said second annular groove (9) of said rotor (13) to prevent said rotor (13) from slipping out of said stationary body (3);

a rocking arm 24, said rocking arm (24) being mounted in a cut-away radial slot portion (16) of a rear-end portion of said stationary body (3) in an insertable manner, said rocking arm (24) having a base-end portion connected with said stationary body (3) through a second pivot (17) which extends in parallel with said front surface of said wing element (2), said rocking arm (24) being provided with a follower portion (23) in the base-end portion, said follower portion (23) abutting against a side surface (21) of said slide cam in a locking conditions, whereby a front-end pushing portion (18) of said rocking arm (24) is for abutting against a support portion (20) of a stationary frame (19), said follower portion (23) further abutting against a rear-end surface (22) of said slide cam (6) in an unlocking condition of said device; and;

a spring (25) rotatably biasing said rocking arm (24) causing said follower portion (23) thereof to abut against said slide cam (6).

2. A locking device as claimed in claim 1, wherein: said front disk portion (10) being provided with a click stop member (38) co-operating with a concave portion of said operating handle (12) to hold said handle (12) in rest position when it is directed in a downward direction.

3. A locking device as claimed in claim 1, wherein said spring (25) is a coiled tension spring disposed to co-act with and restrain said rocking arm (24) to assure freedom of movement of said wing element (2) without interference by said rocking arm (24).

* * * * *